United States Patent [19]

Roberson

[11] 4,126,913

[45] Nov. 28, 1978

[54] OPENING MACHINERY FOR TEXTILE FIBERS

[75] Inventor: James H. Roberson, Greenville, S.C.

[73] Assignee: Crompton & Knowles Corporation, New York, N.Y.

[21] Appl. No.: 686,344

[22] Filed: May 14, 1976

[51] Int. Cl.[2] ..... D01B 1/00

[52] U.S. Cl. ..... 19/96; 19/204; 214/17 D

[58] Field of Search ..... 19/105, 202, 203, 204, 19/205, 86, 96, 80 R, 81, 145.5, 64.5, 97.5, 93, 82; 214/17 D

[56] References Cited

U.S. PATENT DOCUMENTS

| | | | |
|---|---|---|---|
| 2,068,587 | 1/1937 | Aldrich, Jr. | 19/204 |
| 2,780,839 | 2/1957 | Young et al. | 19/93 |
| 3,125,231 | 3/1964 | Mortland | 214/17 D |
| 3,169,664 | 2/1965 | Meinicke | 19/105 X |
| 3,829,934 | 8/1974 | Neu | 19/202 |

FOREIGN PATENT DOCUMENTS

| | | | |
|---|---|---|---|
| 1,007,772 | 10/1965 | United Kingdom | 19/105 |

*Primary Examiner*—Dorsey Newton
*Attorney, Agent, or Firm*—Howard G. Garner

[57] ABSTRACT

Fine opening mechanism for textile fibrous material which comprises a primary opening element such as a spiked beater roll and means for delivering a single undivided mass of textile fibers toward the primary opening element. A plurality of feed elements are located between the primary opening element and the feeding means, each of the feed elements forming a nip through which fibers are fed and presented to the primary opening element so that the mass of fibers are divided into a plurality of fibrous masses.

4 Claims, 4 Drawing Figures

60
10'
13'
12'
14'
20'
19'
18'
51
48'
a
b
58
16'
52
54
56
63
67
65

7"
Z1"
70
Z2"
61
8"
10"
66
68
d
e
9"
64
62
20"
19"
18"
16"

OPENING MACHINERY FOR TEXTILE FIBERS

BACKGROUND OF THE INVENTION

The present invention relates to fine opening machinery for textile fibrous material. Textile fibers are delivered to the fine opening machinery by machinery such as, bale opening equipment or the like in the form of relatively large tufts. The fine opening machinery breaks these relatively large tufts into smaller tufts which are then delivered to other processing or opening machinery such as, lap formers or additional fine opening machinery for reducing the tufts to even smaller tufts.

The general purpose of fine opening machinery is to open the fibers as much as possible. It is desirable to break the fibrous mass which is fed to the fine opening machinery into tufts which are as small as possible. Fine opening machinery generally takes many forms. A typical arrangement is one which includes a chute for holding a reserve of fibers conveyed to the chute from machinery such as bale opening machinery. A feed element such as a pair of rolls is located at the bottom of the chute and forms a nip for drawing fibers thereinto and presenting them to a primary opening element such as a rotating cylinder which contains teeth or spikes on its outer surface. The relatively large tufts in the chute are drawn into the nip of the feed element and held while the teeth of the primary opening element combs the tufts and pulls off small individual tufts which are then conveyed to further processing machinery.

In other types of fine opening machinery, fibers are supplied to the feed elements by a substantially horizontal conveyor on which the unopened fibrous material is deposited and conveyed to the nip of the feed element.

The capacity of the fine opening machinery is measured in terms of mass flow rate of fibers for a given degree of fiber opening. The fibrous mass is delivered to the fine opening machinery at the rate at which machinery prior to opening can supply fibers. In the case of chute feeds, the chute must be of a size which provides a reserve capacity and insures that there will be a continuous and even flow of fiber to the feed element. To achieve this condition, the width of the chute is such so as to require the sidewalls to converge toward the feed element so that all of the fibers are conveyed and condensed to a point above the nip of the feed element as stock is fed down along the chute. The fibers are compressed as they are fed into the nip of the feed element. Although a great deal of compression can be tolerated, there are limits to how tightly the fibers can be held in the nip of the feed element or between the feed rolls if feed rolls are employed without damaging the fibers. In other words, there is a practical limit of mass flow rate of fibers for a given nip opening.

One solution to the above problem is to increase the nip opening of the feed element. This will increase the feed rate of fibers to the primary opening element. However, this has the disadvantage of allowing large tufts to slip through the feed element. These large tufts are "jerked through" by the primary opening element and consequently passed downstream in an unopened condition. The output of the fine opening machinery is increased but additional opening equipment may be needed downstream to further open the fibers.

A second solution is to increase the speed of the feed element. However, the degree of fiber opening is predicated upon the relative speed differential between the feed element and the primary opening element. Consequently, speedup of the feed element requires a proportional speedup of the primary opening element. This will increase the productive capacity of the fine opening machinery while maintaining a fine degree of opening. However, there are practical limitations to how fast this machinery can run without wear and damage. In most cases, the primary opening element is already running at its upper mechanical limit.

A third solution is to divide the flow of fiber which is fed to the fine opening machinery into two or more streams and employ two or more units of fine opening machinery. In this way, the productive capacity of each unit can be brought in to tolerable limits, however, the cost of employing double or triple the number of fine opening units is objectionable.

In fiber opening machinery which employs a chute as a storage or reserve, the expansive forces of the fibers create sidewalls friction which prevents the easy flow of fibers to the feed elements. Very often the feed elements will draw fibers from the center area of the chute and create a cavity because of the bridging capabilities of the fiber to the sidewalls. This may cause a temporary stop or erratic fiber feed to the primary opening element. One solution to this problem is to employ an upper set of rotating "bridge ruffling rolls" located above the feed element. This upper set of "bridge ruffling rolls" ruffles the fiber stock and helps to break up the bridge. It also condensed the fiber stock down to the feed element. Machinery of this type is illustrated in U.S. Pat. Nos. 3,552,800 and 3,851,925. One disadvantage of "bridge ruffling rolls" is that they force the fibers into the nip of the feed element which results in an undersirable nip pressure.

SUMMARY OF THE INVENTION

The primary object of the present invention is to provide fine opening machinery which is capable of handling any given mass flow rate of fibers and still preserve the degree of fine opening required for high quality lap formation. The primary object of the invention is accomplished by providing a plurality of feed elements in association with a single primary opening element.

The number of feed elements is determined by the feeding capacity of the unopened mass of fibers. There will be as many feed elements as are required to pass the fibrous mass between the nips of each feed element without undue pressure and to allow tufts to be passed slowly enough so that they can be broken up by the primary opening means. As in the case of fine opening machines which employ a chute for fiber storage, this prevents bridging and resulting cavitation in the center of the chute and eliminates the need of "bridge ruffling rolls" for ruffling the fibrous mass. By using two or more feed elements, the fibers are not drawn down to the center of the chute. The multiple feed elements divide the chute into as many vertical zones as there are pairs of feed elements, yet there are no vertical walls separating each of these vertical zones which would cause the fibers to bridge. Also, the degree in which the vertical zones are converged toward the nip of the feed elements is greatly diminished which also tends to prevent cavitation.

BRIEF DESCRIPTION OF THE DRAWINGS

The object and other advantages of the invention will become apparent from the following detailed description when taken in conjunction with the accompanying drawings in which.

DETAILED DESCRIPTION OF THE PREFERRED EMBODIMENT

Figure 1:
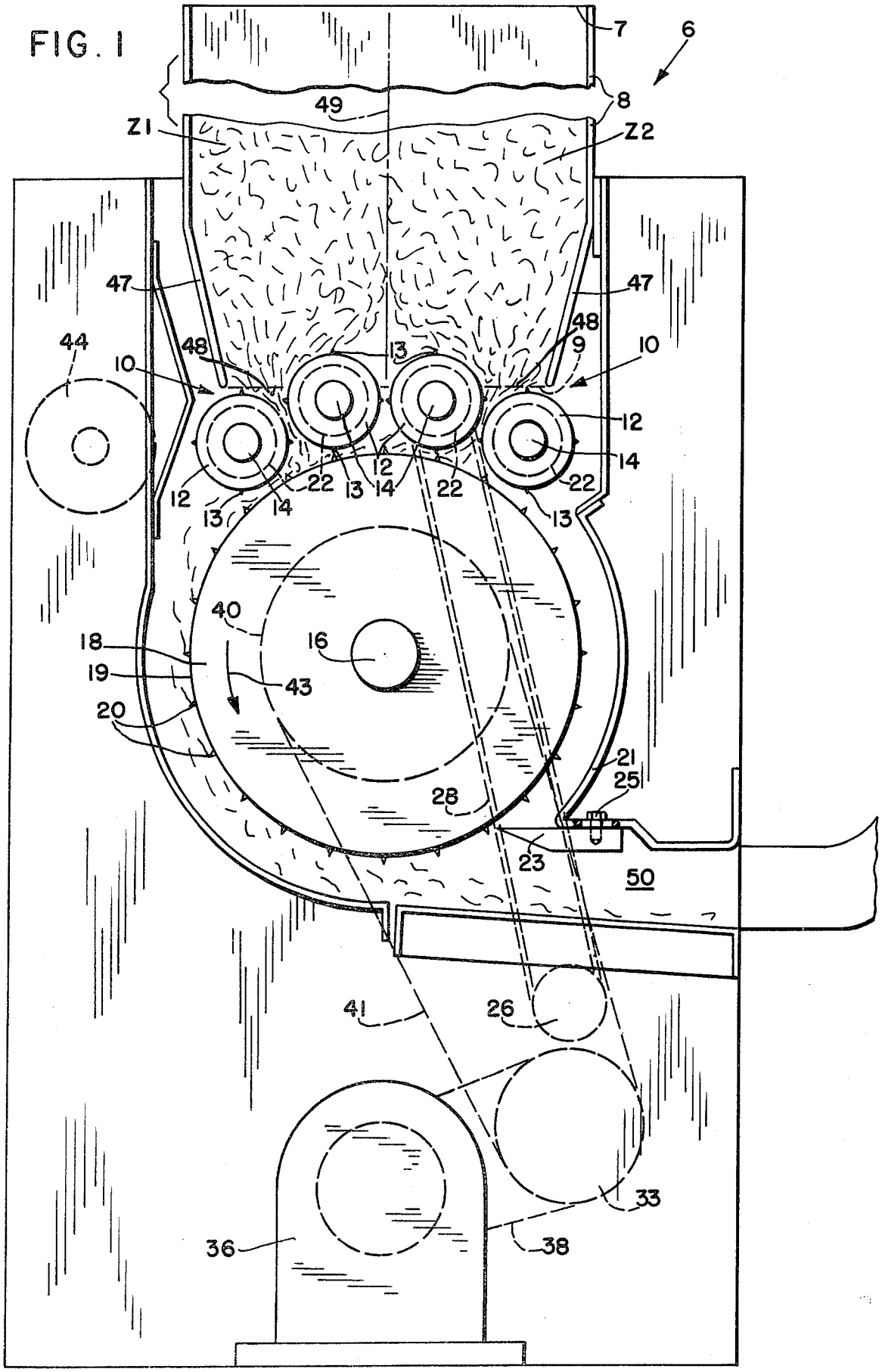
FIG. 1 is a side elevation of the preferred embodiment of the invention with portions in section.
Figure 2:
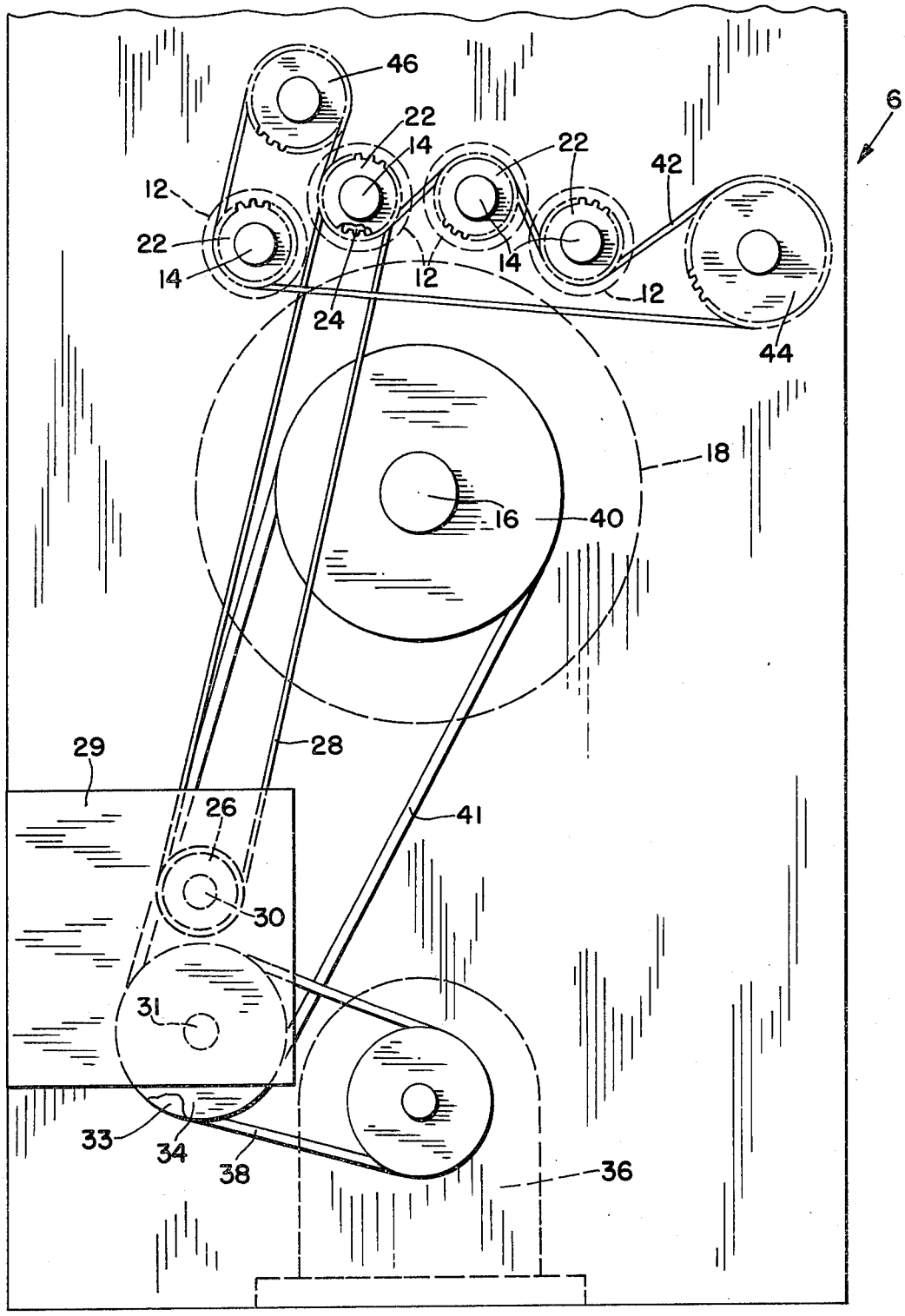
FIG. 2 is a view looking from the opposite side of FIG. 1 showing the various drive components of the invention.

The preferred embodiment of the fine opening mechanism of the present invention is generally indicated by the reference numeral 6 in FIGS. 1 and 2. Mechanism 6 comprises a chute 8 having an upper inlet opening 7 and a lower outlet opening 9. A plurality of feed elements, indicated generally by the reference number 10, are located adjacent the lower opening 9. Each feed element 10 includes a pair of feed rolls 12 which are rotatably mounted on shafts 14. It is preferred that rolls 12 have spikes or pins 13, as shown, but rolls with smooth or fluted surfaces may also be employed, if desired. Shafts 14 are located along an arc swung substantially from the center of shaft 16 on which is mounted a primary opening element or beater roll 18. The outer surface 19 of beater roll 18 contains pins or spikes 20.

Each of the shafts 14 has affixed thereto a sprocket 22. One of the shafts 14, for example, the second from the left as shown in FIG. 2 has affixed thereto an additional sprocket 24 which is driven from a lower sprocket 26 through a chain 28 connected therebetween. Sprocket 26 is mounted on a shaft 30 which extends from a gear reducer 29.

The drive input to gear reducer 29 is through a shaft 31 which extends from gear reducer 29 and has affixed thereto pulleys 33 and 34. A motor 36 drives pulley 34 by means of a belt 38. Pulley 33 drives a pulley 40 which is fixed to the beater roll shaft 16 through a belt 41. Beater roll 18 is rotated in the direction of arrow 43.

A chain 42 extends from a first idler sprocket 44, around the first three sprockets 22 to the right as shown in FIG. 2, then to a second idler sprocket 46 and finally down to the last sprocket 22 to the left, as shown in FIG. 2, and back to the first idler sprocket 44. The manner in which chain 42 is looped around all of the sprockets 22 causes the feed rolls 12 of each feed element 10 to rotate in opposite directions so that the two rolls of each pair move towards the primary opening element 18 at their respective adjacent sides. The pair of rolls 12 of each feed element 10 form a nip 48 into which fibers from the chute 8 enter and are fed to the spikes 20 of primary opening element or beater roll 18. As a safety feature, at least one roll of each pair of rolls 12 could be spring-loaded in a manner well-known in the art.

Drive shafts 30 and 16 are synchronized through gear reducer 29 so that shaft 16 rotates primary opening element or beater roll 18 at a greater surface speed than the feed rolls 12. This has the effect of combing fibers which are presented to beater roll 18 from each feed element 10.

In the lower portion of FIG. 1 located at the inlet of duct 50 is a cutoff blade 23 which is mounted on housing 21 and held in place by a plurality of bolts 25. Cutoff blade 23 extends the length of primary opening element or beater roll 18 and is positioned so as to terminate just short of spikes or pins 20. Blade 23 is therefore positioned so as to assist in removing the fibers from the surface of beater 18 and avoiding having said fibers carried by said beater 18 between housing 21 and said beater. To permit the fibers to continue around with beater 18 would greatly overwork the fibers and result in many broken fibers.

If desired, a spiked endless apron may be employed as the opening means instead of the beater roll shown in the preferred embodiment.

GENERAL OPERATION OF THE PREFERRED EMBODIMENT

During operation of the opening mechanism of the preferred embodiment shown in FIG. 1, textile fibrous material is continuously deposited into the chute 8 through inlet opening 7 by any conventional conveyor means, not shown, but generally well-known in the art. The fibers may be conveyed, for example, from bale opening machinery. The fibers are accumulated in the chute 8 and pass down to the lower end of the chute by gravity. Converging walls 47 at the lower end of the chute help to funnel the fibers toward the feed elements 10. These fibers enter the nip 48 of each feed element and are thereby presented to the primary opening means or beater roll 18. As fibers continually work their way down to the lower end of the chute, they divide into two vertical zones identified as Z1 and Z2, divided by dot and dash line 49. Since there are two pairs of feed elements shown in the embodiment of FIG. 1, the fibers in the left half of the chute 8 or zone Z1 will all be fed down to the left-hand feed element 10 and the fibers on the right side of the chute 8 or zone Z2 will all be fed to the right-hand pair of feed elements 10. Since there is no physical barrier between the two pairs of feed elements and since fibers are not pulled out of the center of the mass of fibers in chute 8, cavitation of the fibers will not occur as in prior art machines which employ chutes for fiber storage.

The fibers which have been combed from the nips of feed elements 10 are carried down to a point beneath beater roll 18 where they are doffed from the roll by any conventional doffing means and such as cut off blade 23 transported by means such as air along a duct 50 to further fiber processing machinery downstream.

Figure 3:
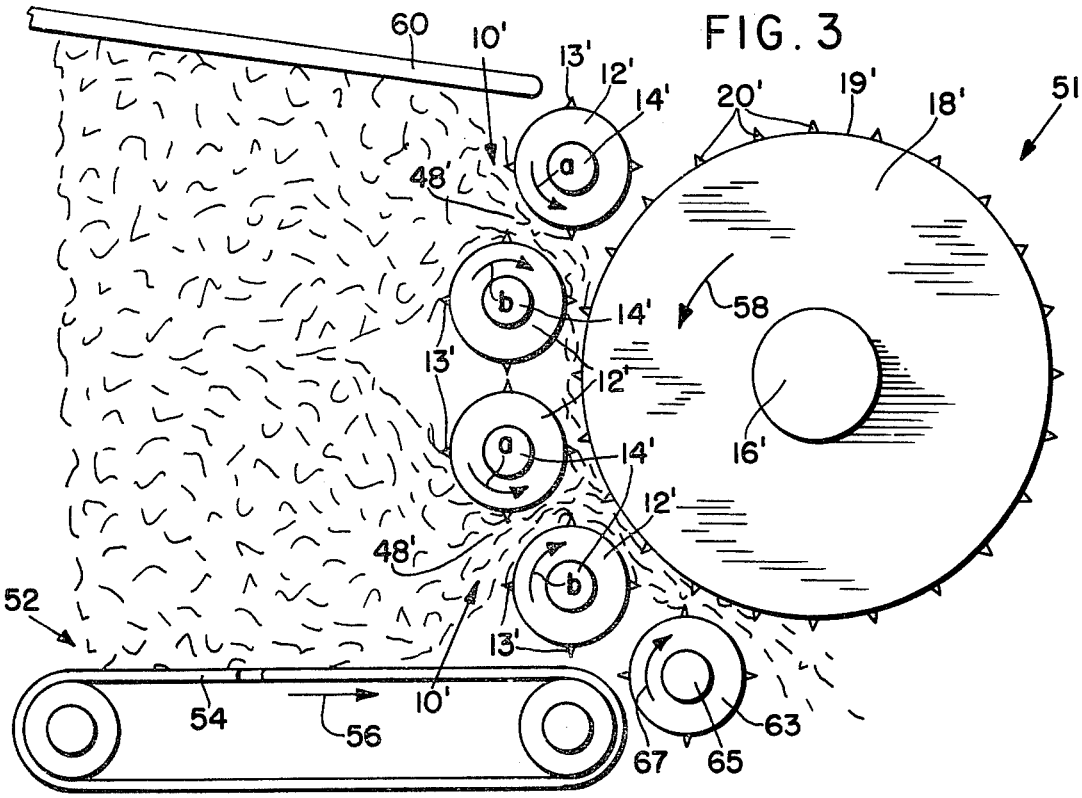
FIG. 3 is a first modification of the invention wherein fibers are fed to the feeding elements by a conveyor.

A redirecting roll such as shown in the first modification in FIG. 3 may also be employed if desired. This roll will be positioned to the left of the last roll 12 to the left as viewed in FIG. 1.

FIRST MODIFICATION

Referring to FIG. 3 there is shown a first modification of the fine opening mechanism of the present invention, generally indicated by reference numeral 51. Opening mechanism 51 comprises a primary opening element or beater roll 18' which is rotatably mounted on a shaft 16'. Beater roll 18' has an outer surface 19' with pins or spikes 20'. The means for feeding fibers to beater roll 18' comprises a conveyor 52 having an upper run 54 which is driven in the direction of arrow 56 toward the primary opening element 18'. A plurality of feed elements generally indicated at 10' are disposed above and toward the forward end of conveyor 52 in cooperating arrangement with primary opening element or beater roll 18'. Each feed element 10' disclosed in this embodiment comprises a pair of feed rolls 12' rotatably mounted on shafts 14' which are located along an arc swung substantially from the center of shaft 16'. Rolls 12' have spikes or pins 13' which project from the surface thereof. Shaft 16' is driven in much the same way as shaft 16 in the preferred embodiment shown on FIG. 1, so that roll 18' rotated in the direction of arrow 58. Rolls 12' are driven in a similar fashion to rolls 12. The pair of rolls 12' of each feed element 10' are driven so that they move toward the beater roll 18' at their respective adjacent sides in the directions indicated by arrows *a* and *b*. Rolls 12' form a nip therebetween through which fibers are passed and presented to the beater roll 18'.

During operation of the first modification, fibers are deposited on the upper run 54 of conveyor 52 from machinery such as a bale opening machine and conveyed toward feed elements 10'. An upper baffle plate 60 assists in directing the fibers toward the feed elements 10'. Squeeze rolls or other conventional mechanism may also be used for condensing the fibers toward feed elements 10'.

A redirecting or stripper roll 63 mounted on a shaft 65 is located beneath the last roll 12' and is driven in the direction of arrow 67. Roll 63 traps fibers which try to blow thru the gap between the beater roll 18' and the last feed roll 12' because of the air pressure developed by roll 18' and redirects the fibers back to the feed rolls 12'.

SECOND MODIFICATION

Figure 4:
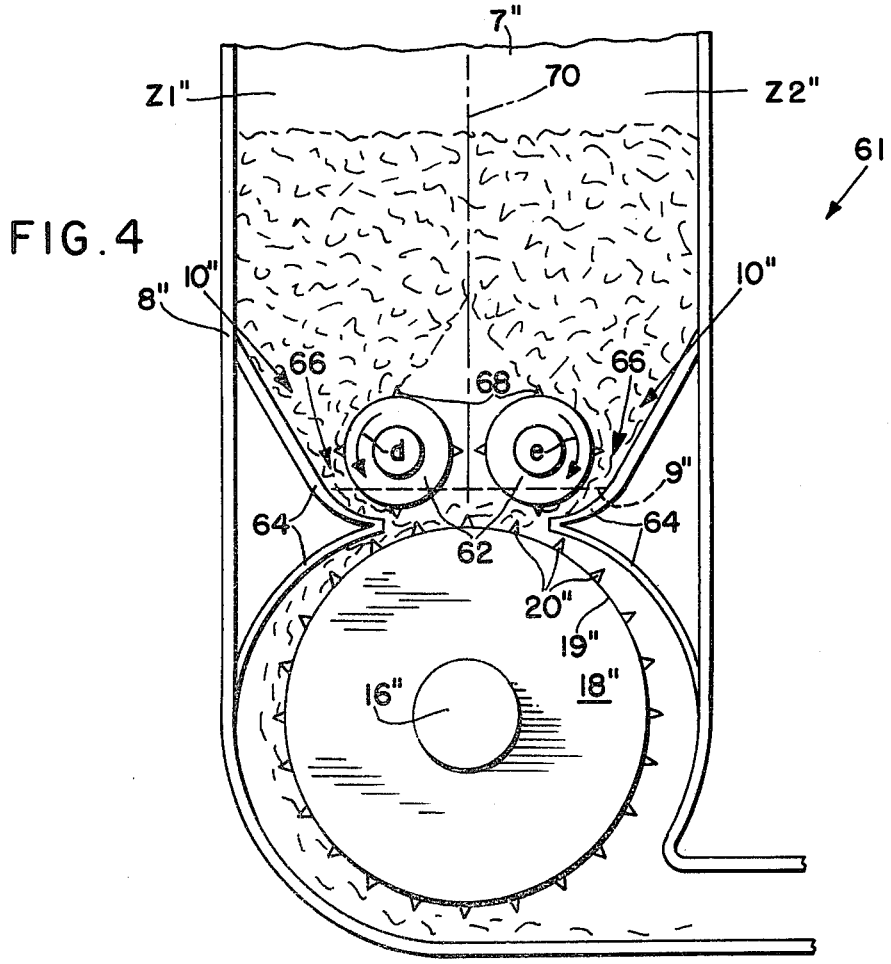
FIG. 4 is a second modification of the invention wherein the feeding elements comprise a rotating roll and a feed plate.

A second modification of the fine opening mechanism of the present invention is illustrated in FIG. 4 and is generally indicated by the reference numeral 61. The opening mechanism 61 comprises a chute 8'' having an inlet opening 7'' and an outlet opening 9''. Located below opening 9'' is a primary opening element or beater roll 18'' mounted on a shaft 16''. Beater roll 18'' has a surface 19'' on which are located spikes or pins 20''. A plurality of feed elements 10'' are located adjacent opening 9''. Each feed element 10'' comprises a feed roll 62 and feed plate 64 which form a nip 66 therebetween. The outer surfaces of rolls 62 have pins 68 extending therefrom for assisting in feeding the fibers through the nip 66. Rolls 16'' are driven in much the same manner as roll 16 in the preferred embodiment and rolls 62 are driven in a fashion similar to rolls 12. Rolls 62 are driven in opposite directions as indicated by arrows d and e so that for each feed element 10'', the surface of the roll which faces the feed plate 64 moves toward the beater roll 18''.

During operation of the second modification, fibers are deposited into chutes 8'' and are fed into the nips 66 of feed elements 10'' and presented to the pins 20'' of beater roll 18''. As in the case of the preferred embodiment, the fibers in the chute 8'' are divided into two vertical zones identified as Z1'' and Z2'' divided by the dot and dash line 70. The fibers from zone Z1'' will be fed to the nip 66 of the left-hand feed element 10'' and the fibers in zone Z2'' will be fed through the nip 66 of the right-hand feed element 10'' as shown in FIG. 4.

I claim:

1. Opening mechanism for textile fibrous material comprising:

(a) a primary opening element which has a spiked moving surface;

(b) means of feeding a single undivided mass of textile fibers towards said primary opening element;

(c) a plurality of pairs of feed rolls located between. said primary opening element and said feeding means, the two rolls of each pair moving towards said primary opening element at their respective adjacent sides and forming a nip therebetween to which said fibers are fed and presented to said primary opening element, whereby said undivided mass of textile fibers is divided into as many individual masses as there are pairs of feed rolls.

2. Opening mechanism for textile fibrous material as set forth in claim 1 wherein said primary opening element is a rotating beater roll and said feed rolls are located along an arc swung substantially from the center of said beater roll.

3. Opening mechanism for textile fibrous material as set forth in claim 1 wherein each of said feed rolls contains spikes which extend from the outer surface thereof.

4. Opening mechanisms for textile fibrous material, comprising:

(a) a primary opening element which has a spiked moving surface;

(b) means for feeding a single individed mass of textile fiber towards said primary opening element; and (c) at least two fiber nipping means interposed between said fiber feeding means and said primary opening element wherein at least one of said nipping means comprises a stationary feed plate and a feed roll cooperating therewith for feeding a portion of said undivided mass of fiber through fiber nip points to said primary opening element and wherein said nip points for each of said nipping means is substantially the same distance from the path of the primary opening element, whereby said undivided mass of fibrous material is divided and a portion thereof is presented to said primary opening element at each of said nip points.

* * * * *